US009048571B2

(12) United States Patent
Hicks et al.

(10) Patent No.: US 9,048,571 B2
(45) Date of Patent: Jun. 2, 2015

(54) GROUNDING DEVICE FOR WELDERS

(71) Applicants: Charles E Hicks, Big Bend, WV (US); Gina Marie Hicks, Big Bend, WV (US)

(72) Inventors: Charles E Hicks, Big Bend, WV (US); Gina Marie Hicks, Big Bend, WV (US)

( * ) Notice: Subject to any disclaimer, the term of this patent is extended or adjusted under 35 U.S.C. 154(b) by 106 days.

(21) Appl. No.: 14/013,840

(22) Filed: Aug. 29, 2013

(65) Prior Publication Data

US 2014/0099802 A1 Apr. 10, 2014

Related U.S. Application Data

(60) Provisional application No. 61/694,506, filed on Aug. 29, 2012.

(51) Int. Cl.

| | |
|---|---|
| ***B25B 11/00*** | (2006.01) |
| ***H01R 13/62*** | (2006.01) |
| *H01R 4/64* | (2006.01) |

(52) U.S. Cl.

CPC ..... *H01R 13/6205* (2013.01); *H01R 4/64* (2013.01)

(58) Field of Classification Search

USPC ..... 269/8, 3, 6, 95, 249, 246, 143; 29/244, 29/270, 271

See application file for complete search history.

(56) References Cited

U.S. PATENT DOCUMENTS

| | | | | |
|---|---|---|---|---|
| 5,971,379 | A * | 10/1999 | Leon, Jr. | 269/8 |
| 6,092,271 | A * | 7/2000 | Stojkovic et al. | 29/281.5 |
| 6,279,885 | B1 * | 8/2001 | Leon, Jr. | 269/8 |
| 7,587,800 | B2 * | 9/2009 | Dasbach et al. | 29/267 |
| 7,618,029 | B2 * | 11/2009 | Haley | 269/8 |
| 2007/0284795 | A1 * | 12/2007 | Lancaster-Larocque | 269/8 |
| 2010/0320663 | A1 * | 12/2010 | Wasinger | 269/8 |
| 2014/0099802 | A1 * | 4/2014 | Hicks et al. | 439/39 |

* cited by examiner

*Primary Examiner* — Lee D Wilson

(74) *Attorney, Agent, or Firm* — Ober, Kaler, Grimes & Shriver; Royal W. Craig

(57) ABSTRACT

A magnetic grounding clamp for portable yet secure connection of a welder grounding lead to any grounding body including irregular-shaped objects such as pipes and metal cylinders. The grounding electrode generally comprises conductive body having a protruding elongate neck, opposing-protruding legs, and a pivoting foot assembly having a disk-like magnet attached distally at the end of each leg. A length-adjustable tungsten grounding electrode protrudes downward from the end of the elongate neck. The body has a tail section with an adjustable spacer protruding therefrom. The spacer see-saws the body about the foot assemblies to maintain the grounding electrode in direct contact with whatever earth structure the cupped magnets are affixed to, thereby ensuring a firm ground contact and reliable ground path for the welder grounding lead.

26 Claims, 2 Drawing Sheets

GROUNDING DEVICE FOR WELDERS

CROSS-REFERENCE TO RELATED APPLICATION(S)

The present application derives priority from U.S. provisional application Ser. No. 61/694,506 filed 29 Aug. 2012.

FIELD OF THE INVENTION

The present invention generally relates to welding accessories and more particularly, to a magnetic grounding electrode for quick-release connection of a welder grounding lead to earth ground using virtually any metal building frame including irregular-shaped objects such as metal tubes.

DESCRIPTION OF PRIOR ART

In electric welding, a workpiece being welded must be connected to the ground conductor or cable of an electrical welding apparatus. This is accomplished by means of a ground clamp connected to both the cable and the workpiece.

Many clamping devices have been proposed to permit a ground wire to be removably affixed to a workpiece during the welding operation. However, the majority of these devices are permanently or semi-permanently attached to the workpiece and maintain the grounding electrode in a fixed relationship with the workpiece. They cannot be easily detached and moved without twisting and potentially damaging the ground wire. This is especially problematic when welding workpieces that must be rotated or moved during the process, such as pipes and cylinders.

In most prior art devices, when the workpiece is rotated during welding, as in welding a circumferential seam in a pipe, the cable becomes wrapped around the workpiece. This wrapping makes such welding inconvenient due to the need to unwrap the cable or to move the clamp periodically. Moreover, this creates a safety hazard inasmuch as it diverts the welder's attention from his work to avoid twisting while the pipe is being rotated.

To address this problem, a number of quick-release magnetic ground clamps have been proposed.

U.S. Pat. No. 6,279,885 by Raymond Leon issued Aug. 28, 2001 shows a magnetic clamp (20) for providing a welding ground to pipe using two magnetic feet (22) and (24) pivoted together at a user-adjustable angle, an attachment post for securing the welder ground lead, and a spring loaded ground terminal (500) protruding downward from between the feet for making contact.

U.S. Pat. No. 2,828,472 to Wondriska issued Feb. 14, 1957 shows an early welding ground clamp using a magnetic block carved with a furrow for seating against pipe.

U.S. Pat. No. 6,708,964 to Dedrick issued Mar. 23, 2004 shows a welding clamp for angled surfaces using two cupped magnets attached together by a flexible shape-memory cable.

United States Patent Application No. 20070034619 by Heard filed Aug. 9, 2006 shows a magnetic ground clamp comprising a single cupped magnet with central spring-loaded grounding lead.

None of the foregoing or any other known prior art provides good, reliable electrical contact between a workpiece and welding apparatus despite irregularly-shaped workpieces, and despite repositioning of the ground electrode.

SUMMARY OF THE INVENTION

In accordance with the foregoing objects, the present invention is a magnetic grounding clamp for portable yet secure connection of a welder grounding lead to earth ground using virtually any grounding body including irregular-shaped objects such as pipes and metal cylinders.

The grounding electrode generally comprises a stabilizing body having a long forwardly-protruding neck, two relatively short opposing legs, and a short tail section. Disk-like magnetic feet are attached distally at the ends of the two opposing legs. Both magnets are seated in a conforming metal cup oriented downward, open-faced, for magnetic anchoring of the body to a separate underlying grounding body. The cupped magnets are attached to the legs by spring-loaded screws inserted through pivot pins held captive in the legs, such that the magnetic feet can pivot through a range of angular orientations about the axis of the neck. The magnetic feet are fully insulated from the body. The pivoting ability allows the cupped magnetic feet to conform to irregular, e.g., cylindrical surfaces. In addition, the spring-loaded screws offer a range of tri-axial freedom such that the body remains free to see-saw about the legs. An adjustable and insulated set screw is threaded through the tail section and bears against the underlying ground body, taking advantage of the see-saw freedom to allow vertical adjustment of the height of the neck. This set screw includes a thumb screw atop the tail section to anchor a welder grounding lead (to earth ground). The elongate neck inclines upward, then horizontal, and then arches down along its length to serve as a carry-handle. A length-adjustable tungsten grounding electrode is carried at the distal end of the neck. The distal tip of the grounding electrode protrudes directly downward toward the earth structure and is tapered to a point. The forwardly biased see-saw bracket maintains the grounding electrode in direct contact with whatever earth structure the cupped magnets are affixed to, thereby ensuring a firm ground contact and reliable ground path for the welder grounding lead.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

The present invention is a magnetic grounding clamp for portable yet secure connection of a welder grounding lead to earth ground using virtually any grounding body including irregular-shaped objects such as pipes and metal cylinders.

Figure 1:
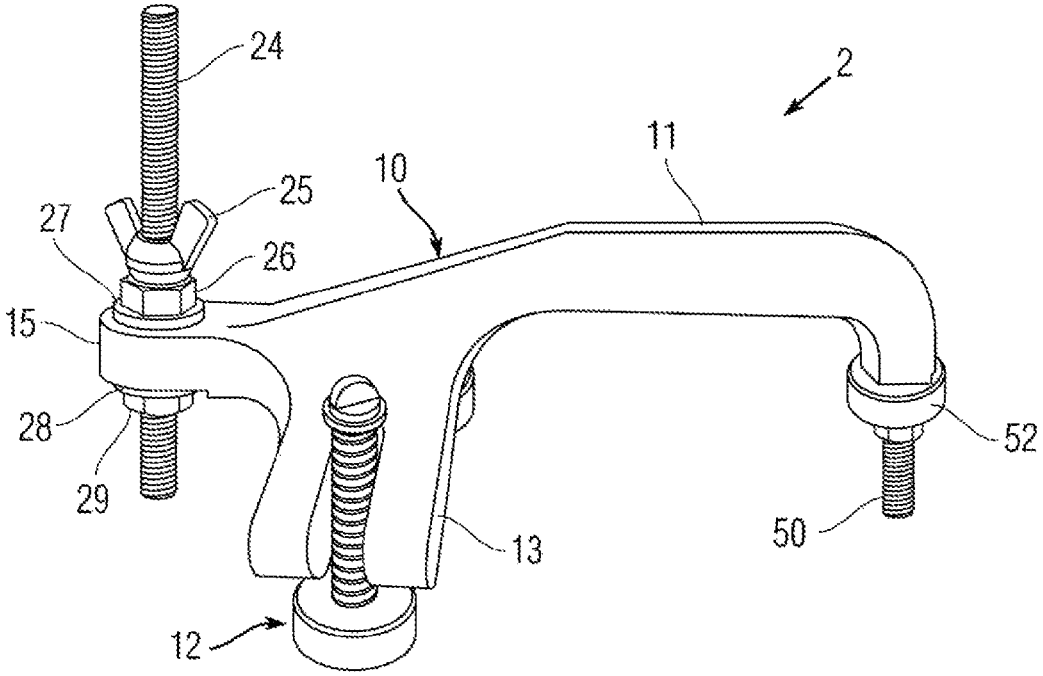
FIG. 1 is a side perspective view of an exemplary magnetic grounding clamp 2 according to an embodiment of the invention.
Figure 2:
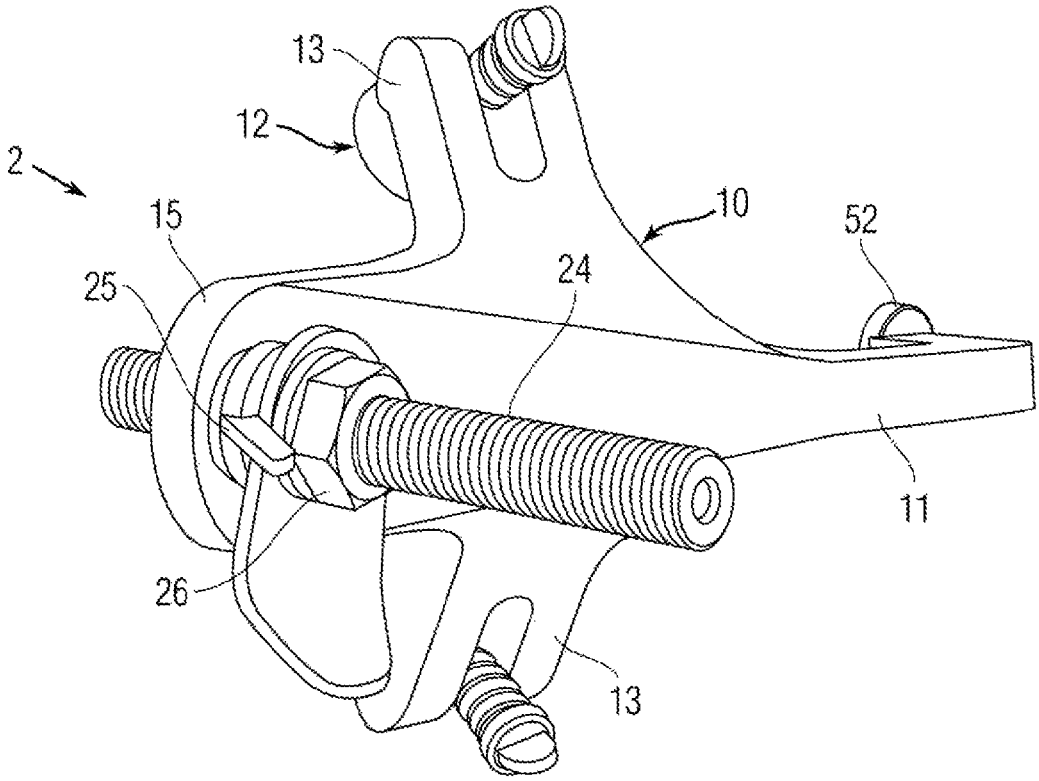
FIG. 2 is a top perspective view of the magnetic grounding clamp 2 of FIG. 1.

With collective reference to FIGS. 1-2, the magnetic grounding clamp 2 generally comprises a stabilizing body 10 having a long forwardly-protruding neck 11, two relatively short opposing legs 13, and a short tail section 15. A disk-magnetic foot assembly 12 is attached distally at the end of each leg 13. The body 10 is preferably formed as a unitary cast-aluminum member shaped as a quadruped, though other suitable material may exist. The legs 13 protrude perpendicularly on opposing sides of body 10 and are preferably angled (as shown) or arched downward therefrom slightly downward to provide elevation and to supinate the magnetic feet assemblies 12 slightly.

Figure 3:
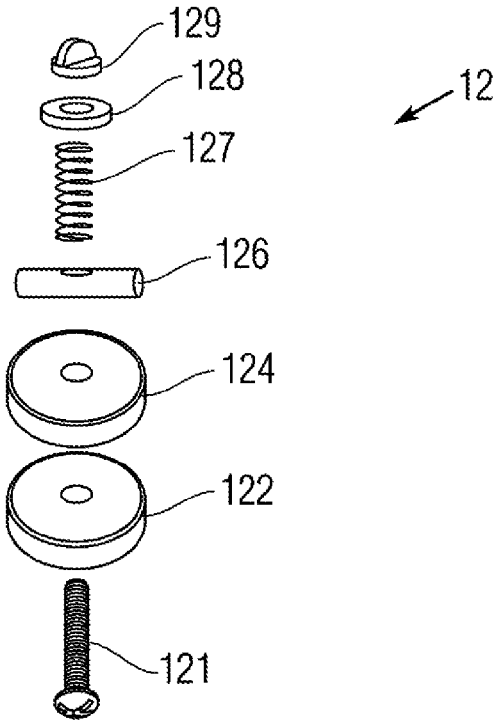
FIG. 3 is an exploded view of a magnetic foot assembly 12.

FIG. 3 is an exploded view of a magnetic foot assembly 12. Each magnetic foot 12 assembly further comprises an annular disk-shaped magnet 122 housed inside an open-faced conforming metal cup 124, both having a through bore. The metal cup 124 is open-faced-downward for magnetic anchoring of the magnet 122 directly to the underlying grounding body. The magnet 122/cup 124 combination is attached beneath a horizontal insulating pivot pin 126, preferably formed as a cylinder of durable plastic such as nylon, Delrin® or poly vinyl chloride. Pivot pin 126 likewise has a through bore. A machine screw 121 is inserted up through the magnet 122/cup 124/pivot pin 126 combination, and a spring 127 rides the machine screw 121 above the pivot pin 126. The head of the machine screw 121 is seated inside the open circle of the annular magnet 122 so as not to obstruct a flush magnetic attraction. The spring 127 is held in place by a cap nut 129 and washer 128 secured to the distal end of the machine screw 121. The pivot pin 126 is pivotally mounted in the distal ends of leg 13 for rotation about an axis generally coaxial with the neck 11. In this regard the distal ends of legs 13 are formed as yokes with opposing prongs for straddling the spring 127 and machine screw 121. The prongs of legs 13 are defined by horizontal grooves for seating both ends of the pivot pin 126 (as seen in FIGS. 1-2). The foregoing configuration ensures that the cupped magnetic foot assemblies 12 are fully insulated from the body 10 and yet maintain a degree of pivoting freedom. The magnetic feet can pivot through a range of angular orientations about the axis of the neck 11. This pivoting ability allows the cupped magnetic feet assemblies 12 to conform to irregular, e.g., cylindrical surfaces.

In addition, the machine screw 121 is preferably slightly smaller in diameter than the apertures in the magnet 122/cup 124/pivot pin 126 so that the spring-loaded screw 121 offers a small range of damped tri-axial freedom. This helps to ensure that the body 11 remains free to see-saw about the legs 13, and also contributes to the pivoting ability which allows the cupped magnetic feet assemblies 12 to conform to irregular surfaces.

Referring back to FIG. 1, the elongate neck 11 inclines upward, then remains horizontal, and then arches down along its length to serve as a carry-handle. The carry-handle serves its self-described purpose and also provides a support for attachment of the grounding wire (shown).

The neck 11 protrudes forwardly to its distal downwardly-arched end, which carries a length-adjustable tungsten grounding electrode 50. The distal tip of the grounding electrode 50 protrudes directly downward toward the underlying grounding structure and is tapered to a point. The electrode 50 is threadably inserted in the distal end of neck 11, and preferably carries a larger-diameter compression nut 52 with ribbed periphery. This way, the electrode 50 can be length-adjusted by varying degrees of screw-insertion into the end of neck 11 and, at the desired length, the compression nut 52 can be thumb-tightened against the neck 11 to lock the electrode 50 in place.

An elongate set screw 24 is threadably inserted vertically through the tail section 15 of body 10. The set screw 24 may be threaded no more or less into tail section 15, and fixed in position by opposing washers 27, 28 and nuts 26, 29 on either side of tail section 15. A wing-nut 25 is screw-inserted onto set screw 24. A welder grounding wire may be attached to the set screw 24 and secured in place by wing-nut 25. The grounding wire will typically have a stirrup-type electrical connector that can be inserted directly onto set screw 24.

It should now be apparent that the body 10 remains free to see-saw about the magnetic foot assemblies 12 vis-à-vis the freedom of motion of the latter, and so the downward extension of the elongate set screw 24 can be adjusted as needed to adjust the height of the neck 11. The height of the neck 11 and the protrusion of electrode 50 can both be adjusted to maintain the sharp tip of the electrode 50 in direct contact with whatever earth structure the cupped magnetic feet assemblies 12 are affixed to, and the bias imparted by springs 127 against the magnetic feet 122 keeps this bias to ensure that contact is maintained even despite impacts or jostling to the workpiece. This ensures a firm ground contact and reliable ground path for the welder grounding lead.

Figure 4:
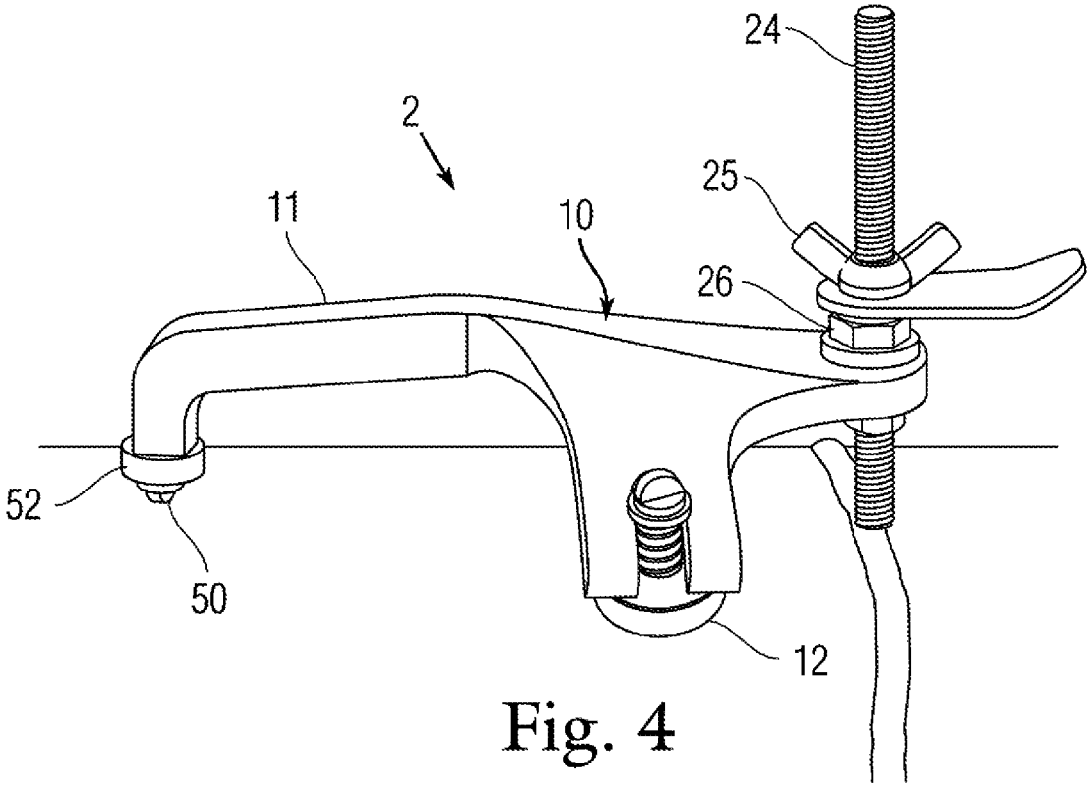
FIG. 4 is an opposite-side perspective view of the magnetic grounding clamp 2 of FIGS. 1-2 in use during pipe-welding.

FIG. 4 is an opposite-side perspective view of the magnetic grounding clamp 2 of FIGS. 1-2 in use during pipe-welding.

In operation, the downwardly-protruding set screw 24 bears against the workpiece (here a sewer pipe) and see-saws the body 10 and neck 11 rearwardly to firmly maintain the sharp tip of the grounding electrode 50 in direct contact with the sewer pipe. The cupped magnetic feet assembled 12 account for the curvature of the pipe as well as significant shape irregularities and surface imperfections. The synergistic combination of these features thereby ensures a firm ground contact and reliable ground path for the welder grounding lead. Moreover, the entire device can be quick-released and easily repositioned as desired.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. A magnetic grounding clamp for connection of a grounding lead to earth ground, comprising:

a body having a long protruding neck, two opposing legs extending on opposing sides of said neck, and a tail section protruding opposite said neck;

a pair of magnetic foot assemblies, each said magnetic foot assembly being attached distally at the end of a corresponding leg and including a magnet for fixation to a metal workpiece;

a tungsten grounding electrode attached distally to said protruding neck; and an adjustable spacer attached to the tail section of said body and protruding through said tail section by an adjustable length for contacting said metal workpiece, whereby length-adjustment of said spacer see saws said body about said pair of magnetic foot assemblies to force said tungsten grounding electrode into contact with said metal workpiece.

2. The magnetic grounding clamp according to claim 1, wherein said adjustable spacer attached to the tail section of said body comprises a set screw threaded through the tail section of said body.

3. The magnetic grounding clamp according to claim 2, further comprising a wing nut threaded onto said set screw spacer on one side of said body for holding a grounding lead captive thereon.

4. The magnetic grounding clamp according to claim 2, further comprising a pair of nuts threaded onto said set screw on opposing sides of said body for affixing a position of said set screw within the tail section of said body.

5. The magnetic grounding clamp according to claim 1, wherein each said magnetic foot assembly is configured to pivot about an axis substantially parallel to said neck.

6. The magnetic grounding clamp according to claim 5, wherein each said magnetic foot assembly comprises an annular disk-shaped magnet housed inside an open-faced conforming metal cup.

7. The magnetic grounding clamp according to claim 6, wherein both of said annular disk-shaped magnets and open-faced metal cups have a central through-bore, and a screw inserted through said through-bores.

8. The magnetic grounding clamp according to claim 7, wherein a distal end of both of said legs is configured as a split yoke.

9. The magnetic grounding clamp according to claim 8, further comprising a pivot pin carried in the split yoke of each of said legs.

10. The magnetic grounding clamp according to claim 9, wherein said pivot pin comprises a central through-bore, and the screw inserted through said annular disk-shaped magnet and open-faced metal cup traverses the central through-bore of said pivot pin and protrudes therefrom.

11. The magnetic grounding clamp according to claim 10, further comprising a compression spring mounted on the protruding screw adjacent said pivot pin.

12. The magnetic grounding clamp according to claim 10, wherein said pivot pin is formed of non-conductive material.

13. The magnetic grounding clamp according to claim 10, wherein said pivot pin is formed of plastic.

14. The magnetic grounding clamp according to claim 11, wherein said compression spring is held captive on said screw by a cap nut and washer combination.

15. The magnetic grounding clamp according to claim 10, wherein said screw has a diameter smaller than the apertures in said disk-shaped magnet, open-faced metal cup and pivot pin.

16. The magnetic grounding clamp according to claim 1, wherein said tungsten grounding electrode is screw-threaded through said neck.

17. The magnetic grounding clamp according to claim 16, wherein said tungsten grounding electrode is formed with a sharp protruding tip.

18. The magnetic grounding clamp according to claim 16, further comprising a compression nut threaded onto said tungsten grounding electrode for affixing a position of said tungsten grounding electrode within said neck.

19. A magnetic grounding clamp for connection of a grounding lead to earth ground, comprising:

a body having a long protruding neck, two opposing legs extending on opposing sides of said neck, and a tail section protruding opposite said neck, a distal end of both of said legs being configured as a split yoke;

a pair of magnetic foot assemblies for fixation to a metal workpiece, each said magnetic foot assembly being attached distally at the yoked end of a corresponding leg by a pivot pin, and further including an annular disk-shaped magnet housed inside an open-faced conforming metal cup, and a screw inserted through said disk-shaped magnet, cup, and pivot pin, whereby each said magnetic foot assembly is configured to pivot about said pivot pin relative to said legs;

a tungsten grounding electrode attached distally to said protruding neck; and an adjustable spacer attached to the tail section of said body for contacting said metal workpiece.

20. The magnetic grounding clamp according to claim 19, wherein said adjustable spacer protrudes through said tail section by an adjustable length.

21. The magnetic grounding clamp according to claim 5, whereby length-adjustment of said spacer see saws said body about said pair of magnetic foot assemblies to force said tungsten grounding electrode into contact with said metal workpiece.

22. The magnetic grounding clamp according to claim 19, wherein said adjustable spacer attached to the tail section of said body comprises a set screw threaded through the tail section of said body.

23. The magnetic grounding clamp according to claim 22, further comprising a wing nut threaded onto said set screw spacer on one side of said body for holding a grounding lead captive thereon.

24. The magnetic grounding clamp according to claim 22, further comprising a pair of nuts threaded onto said set screw on opposing sides of said body for affixing a position of said set screw within the tail section of said body.

25. The magnetic grounding clamp according to claim 19, wherein said pivot pin comprises a central through-bore, and the screw inserted through said annular disk-shaped magnet and open-faced metal cup traverses the central through-bore of said pivot pin and protrudes therefrom.

26. A magnetic grounding clamp for connection of a welder grounding lead to earth ground, comprising:

a two-legged body having a protruding neck;

a magnetic foot attached distally at the end of each leg of said body, each said magnetic foot further comprising a cup-shaped housing partially enclosing an annular magnet;

a length-adjustable tungsten grounding electrode attached distally to said neck.

* * * * *